US008092149B2

(12) United States Patent
Vaghi

(10) Patent No.: US 8,092,149 B2
(45) Date of Patent: Jan. 10, 2012

(54) IMPELLER ARRANGEMENT

(75) Inventor: Francesco Vaghi, Cheltenham (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 1056 days.

(21) Appl. No.: 11/958,501

(22) Filed: Dec. 18, 2007

(65) Prior Publication Data

US 2008/0152499 A1 Jun. 26, 2008

(30) Foreign Application Priority Data

Dec. 21, 2006 (GB) ..... 0625506.1

(51) Int. Cl.
*F01D 1/30* (2006.01)

(52) U.S. Cl. ..... 415/82; 415/903; 415/911; 416/155

(58) Field of Classification Search ..... 415/82, 415/130, 149.3, 150, 901, 902, 903, 911; 416/155, 156
See application file for complete search history.

(56) References Cited

U.S. PATENT DOCUMENTS

| | | | | |
|---|---|---|---|---|
| 762,454 | A | 6/1904 | Sturgeon | |
| 1,922,238 | A | 8/1933 | Freed | |
| 2,666,618 | A * | 1/1954 | Jaquith | 415/159 |
| 3,860,357 | A | 1/1975 | Grainger | |

FOREIGN PATENT DOCUMENTS

| | | |
|---|---|---|
| GB | 28931 | 3/1910 |
| GB | 18868 | 9/1912 |
| GB | 105037 | 3/1917 |
| GB | 110297 | 10/1917 |
| GB | 1108927 | 4/1968 |

* cited by examiner

*Primary Examiner* — Nathaniel Wiehe
(74) *Attorney, Agent, or Firm* — Jeremy P. Welch

(57) ABSTRACT

An impeller arrangement comprises an impeller 10 having at least one first vane surface 26 orientated such that the application of fluid under pressure thereto applies a torque to the impeller 10 in a first rotary direction, at least one second vane surface 28 orientated such that the application of fluid under pressure thereto applies a torque to the impeller 10 in a second, opposite rotary direction, and a valve 34 operable to control the supply of fluid to the first and second vane surfaces 26, 28.

8 Claims, 2 Drawing Sheets

IMPELLER ARRANGEMENT

BACKGROUND TO THE INVENTION

This invention relates to an impeller arrangement for use in applying a rotary force to a body derived from a flow of fluid.

A conventional, fixed blade impeller includes a number of blades angled to the fluid flow direction. In such an arrangement, the torque which is generated by the impeller is related to the mass of the fluid diverted by the blades and the angle of deviation of the fluid, which is dependent upon the blade profile and angle.

In a known downhole steerable drilling system, two impellers are mounted on a body, the impellers being designed to rotate in opposite directions, clutch devices being provided to control the transmission of torque to the body. By appropriate control of the clutch devices, the body can be held in a desired geostationary position. The impellers are designed to rotate at high speed, for example at speeds of up to 2500 rpm, generating mechanical friction and viscous drag. Any imbalance between the friction and drag of the two impellers, for example due to particles in the fluid causing jamming, can result in the system becoming unstable. Further, wear of the impellers and associated components can be significant.

SUMMARY OF THE INVENTION

It is an object of the invention to provide an impeller arrangement in which the magnitude and direction of the applied torque can be varied.

According to the present invention there is provided an impeller arrangement comprising an impeller having at least one first vane surface orientated such that the application of fluid under pressure thereto applies a torque to the impeller in a first rotary direction, at least one second vane surface orientated such that the application of fluid under pressure thereto applies a torque to the impeller in a second, opposite rotary direction, and a valve operable to control the supply of fluid to the first and second vane surfaces.

It will be appreciated that by controlling the valve to control the proportion of fluid applied to each of the first and second vane surfaces, the magnitude and direction of the applied torque can be controlled.

Conveniently, the impeller defines at least one first flow channel defined, in part, by the first vane surface, and at least one second flow channel defined, in part, by the second vane surface, and the valve controls the proportion of fluid flowing along each of the first and second flow channels. The valve is conveniently movable between a first position in which the first flow channel is open and the second flow channel is closed, and a second position in which the second flow channel is open and the first flow channel is closed. The valve may further have one or more intermediate positions in which the magnitude of the applied torque is reduced. The valve conveniently comprises a valve plate rotatable, in use, with the impeller, but angularly adjustable between its first and second positions.

Preferably, the valve is designed to maintain a substantially uniform flow area irrespective of the position of the valve.

BRIEF DESCRIPTION OF THE DRAWINGS

The invention will further be described, by way of example, with reference to the accompanying drawings, in which.

DETAILED DESCRIPTION OF THE PREFERRED EMBODIMENTS

Figure 1:
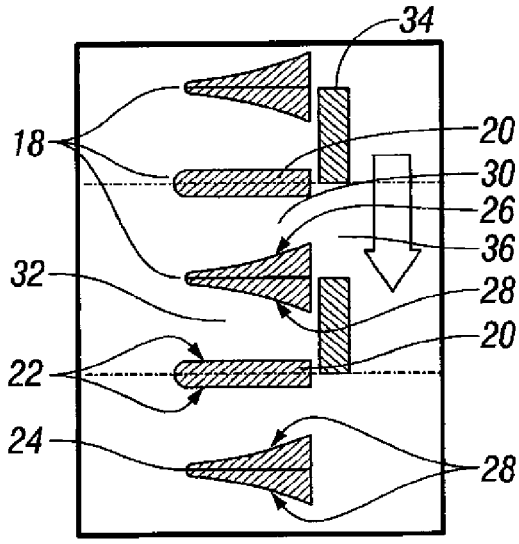
FIG. 1 is a schematic representation of part of an impeller arrangement in accordance with one embodiment of the invention.

Referring to the accompanying drawings there is illustrated an impeller arrangement comprising an impeller 10 supported by bearings 12 for rotation within a cylindrical housing 14. The impeller 10 and housing 14 together define an annular flow passage 16 along which fluid is pumped by means not shown. The impeller 10 is provided with a series of impeller vanes 18. The vanes 18 are of two different types. A first type 20 of vane 18 acts only as a flow guide, this type 20 of vane 18 having a pair of opposite side walls 22 which are generally parallel to one another. In use, the application of fluid under pressure flowing along the annular passage 16 to these vanes 18 does not impart rotation to the impeller 10, these vanes serving merely as flow guides and separators.

A second type 24 of vane 18 is also provided, the types 20, 24 being arranged to alternate with one another around the periphery of the impeller 10. Each vane 18 of the second type 24 includes a first vane surface 26 and a second, opposing vane surface 28. The orientation of the vane surfaces 26 is such that a flow of fluid along the annular flow passage 16 and through a first channel 30 defined between the first vane surface 26 and a surface 22 of an adjacent one of the vanes 18 of the first type 20 results in the application of a torque to the impeller 10 urging the impeller to rotate in a clockwise direction. The second vane surfaces 28 are oppositely orientated such that a flow of fluid along a second flow channel 32 defined between the second vane surface 28 and a surface 22 of an adjacent one of the vanes 18 of the first type 20 applies a counter-clockwise torque to the impeller 10.

Figure 3:
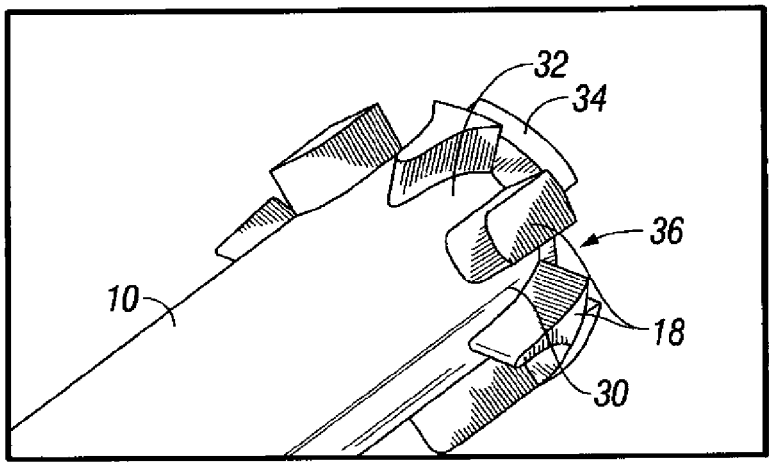

The impeller arrangement further comprises a valve in the form of a valve plate 34 arranged to be carried by the impeller 10 so as to be rotatable therewith, in use. The valve plate 34 is in the form of a substantially disc-like member having, at its outer periphery, a plurality of cut-outs 36 formed therein. The cut-outs 36 are positioned and of dimensions such that, when the valve plate 34 occupies a first angular position relative to the impeller 10, the cut-outs 36 align with the first flow channels 30, the valve plate 34 closing the second flow channels 32. Consequently, fluid flowing along the annular passage 16 is only permitted to flow through the first flow channels 30, imparting a clockwise torque to the impeller 10. As fluid is unable to flow through the second flow passages 32, the second vane surfaces 28 are effectively inactive. The impeller arrangement is shown in this position in FIGS. 1 and 3.

Figure 2:
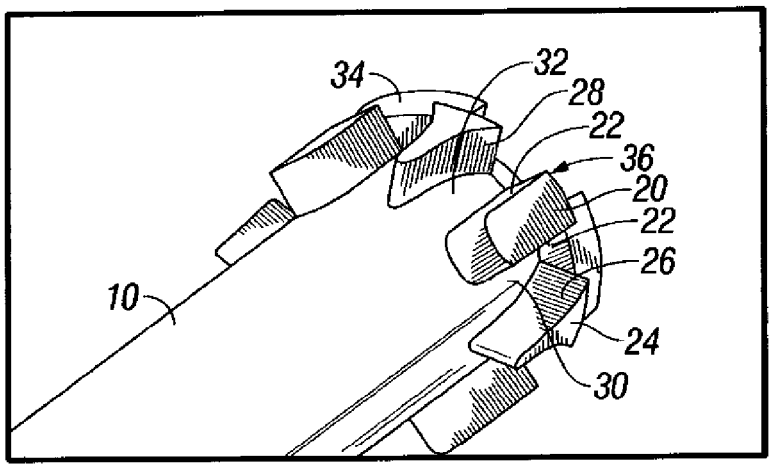
FIGS. 2 to 4 are perspective views illustrating the impeller arrangement in three different operating modes.

Movement of the valve plate 34 from this position to the position illustrated in FIG. 2 results in the first flow passages 30 being closed and in the second flow passages 32 opening. Consequently, the first vane surfaces 26 become inactive as fluid is unable to flow through the first flow passages 30, and the second vane surfaces 28 become active. The flow of fluid through the second flow passages 32 and acting upon the second vane surfaces 28 results in the application of a counter-clockwise directed torque to the impeller 10.

Figure 4:
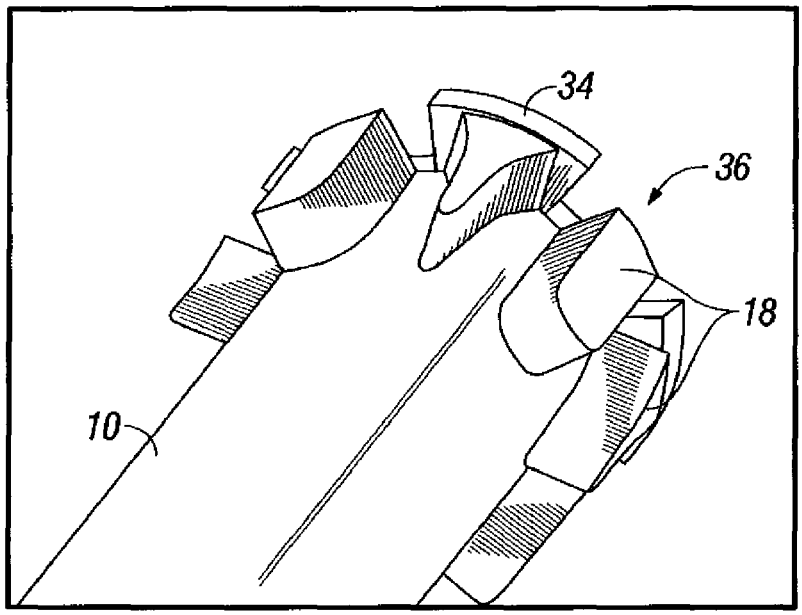
Figure 5:
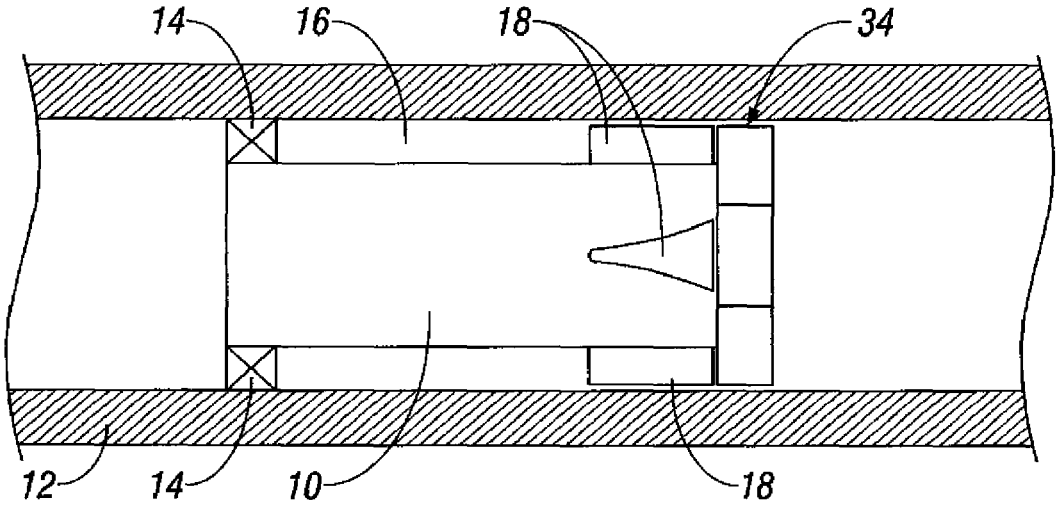
FIG. 5 is a diagram illustrating the impeller arrangement.

FIG. 4 illustrates the impeller arrangement with the valve plate 34 in an intermediate position in which the first and second flow passages 30, 32 are both partially closed. In this position, approximately equal proportions of the fluid will flow through the first and second flow passages 30, 32, thus the torque applied to the impeller 10 by the action of the fluid upon the first vane surfaces 26 will be substantially cancelled out by the action of the fluid upon the second vane surfaces 28. Substantially no net torque will be applied to the impeller 10 in this mode of operation. The valve plate 34 can, of course, occupy a number of other angular positions in which other magnitudes of net torque can be applied to the impeller 10.

It will be appreciated that by appropriate control over the angular position of the valve plate 34 relative to the impeller 10, both the direction of the applied torque and the magnitude thereof can be controlled, the maximum magnitude occurring when the respective ones of the flow passages 30, 32 are closed.

It is anticipated that the power required to move the valve plate 34 relative to the impeller 10 will be relatively low, being related to the friction between the valve plate 34 and the impeller 10, and the inertia of the valve plate 34. Consequently, a motor or the like required to move the valve plate 34 relative to the impeller 10 need only be of relatively low power.

Advantageously, the valve plate 34 and cut-outs 36 provided therein are designed such that the flow area of the impeller arrangement is substantially constant regardless as to the angular position of the valve plate 34. Consequently, the pressure drop across the impeller arrangement is dependent only upon the total flow rate through the system rather than being related to the angular position of the valve plate 34.

The impeller arrangement may be used in a wide range of applications. For example, it may be used in the control of the position of a body in a control unit for a downhole, steerable drilling system. It will be appreciated that, compared to typical arrangements, the impeller arrangement may be used to replace both of the impellers of a typical arrangement. However, the impeller arrangement may be used in a number of other applications, for example in a strap-down configuration in which the flow can be diverted from a reversible stator acting upon a neutral blade impeller fixed to a moving shaft.

It will be appreciated that a wide range of other modifications and alterations may be made without departing from the scope of the invention. One such possible modification is to re-locate the valve plate 34 so as to be located adjacent the upstream edges of the vanes 18 rather than located adjacent the downstream edges thereof as in the illustrated embodiment. Further, the valve may take a number of other forms.

The invention claimed is:

1. An impeller arrangement comprising an impeller having at least one first vane surface orientated such that the application of fluid under pressure thereto applies a torque to the impeller in a first rotary direction, at least one second vane surface orientated such that the application of fluid under pressure thereto applies a torque to the impeller in a second, opposite rotary direction, and a valve operable to control the supply of fluid to the first and second vane surfaces.

2. An arrangement according to claim 1, wherein the impeller defines at least one first flow channel defined, in part, by the first vane surface, and at least one second flow channel defined, in part, by the second vane surface, and the valve controls the proportion of fluid flowing along each of the first and second flow channels.

3. An arrangement according to claim 2, wherein the valve is movable between a first position in which the first flow channel is open and the second flow channel is closed, and a second position in which the second flow channel is open and the first flow channel is closed.

4. An arrangement according to claim 3, wherein the valve has one or more intermediate positions in which the magnitude of the applied torque is reduced.

5. An arrangement according to claim 1, wherein the valve comprises a valve plate rotatable, in use, with the impeller, but angularly adjustable relative thereto.

6. An arrangement according to claim 5, wherein the valve plate is located immediately upstream of the first and second vane surfaces.

7. An arrangement according to claim 5, wherein the valve plate is located immediately downstream of the first and second vane surfaces.

8. An arrangement according claim 1, wherein the valve is designed to maintain a substantially uniform flow area across the impellor arrangement irrespective of the position of the valve.

* * * * *